US011168559B2

(12) United States Patent
Dobkins et al.

(10) Patent No.: US 11,168,559 B2
(45) Date of Patent: Nov. 9, 2021

(54) CONTROLLING A COILED TUBING UNIT AT A WELL SITE

(71) Applicants: Kenneth P. Dobkins, Conroe, TX (US); Bo Wu, Spring, TX (US); Christopher Paul Sartori, The Woodlands, TX (US); William A. Aitken, Calgary (CA); Timothy T. Ramsey, Spring, TX (US); Stuart J. Murphy, Spring, TX (US)

(72) Inventors: Kenneth P. Dobkins, Conroe, TX (US); Bo Wu, Spring, TX (US); Christopher Paul Sartori, The Woodlands, TX (US); William A. Aitken, Calgary (CA); Timothy T. Ramsey, Spring, TX (US); Stuart J. Murphy, Spring, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 403 days.

(21) Appl. No.: 16/285,339

(22) Filed: Feb. 26, 2019

(65) Prior Publication Data

US 2020/0270978 A1 Aug. 27, 2020

(51) Int. Cl.

| | |
|---|---|
| ***E21B 19/08*** | (2006.01) |
| ***E21B 44/02*** | (2006.01) |
| ***E21B 47/06*** | (2012.01) |

(52) U.S. Cl.

CPC ..... *E21B 44/02* (2013.01); *E21B 19/08* (2013.01); *E21B 47/06* (2013.01)

(58) Field of Classification Search

CPC ..... E21B 19/08; E21B 19/22; E21B 44/02; E21B 47/06

See application file for complete search history.

(56) References Cited

U.S. PATENT DOCUMENTS 5,850,874 A 12/1998 Burge et al.
6,116,345 A * 9/2000 Fontana ..... B65H 75/22 166/343

(Continued)

FOREIGN PATENT DOCUMENTS

| | | | |
|---|---|---|---|
| CA | 2495918 | A1 | 6/2005 |
| CA | 2663989 | A1 | 4/2008 |
| WO | 2016044566 | A1 | 3/2016 |

OTHER PUBLICATIONS

International Search Report Issued in International Application No. PCT/US2020/019870 dated Jun. 23, 2020; 3 Pages.

(Continued)

*Primary Examiner* — Matthew R Buck
(74) *Attorney, Agent, or Firm* — Cantor Colburn LLP

(57) ABSTRACT

A method for controlling a coiled tubing unit at a well site having a wellbore that extends downhole from a surface of the well site is provided. The method includes creating a coiled tubing simulation for performing a coiled tubing operation. The method further includes receiving wellbore data. The wellbore data includes downhole data collected using a downhole sensor downhole in the wellbore, and the downhole data includes a differential pressure measurement. The method further includes generating an automated coiled tubing control plan for the coiled tubing unit based at least in part on the wellbore data and the coiled tubing simulation. The method further includes controlling the coiled tubing unit using the automated coiled tubing control plan to regulate at least one of a rate-of-penetration of the coiled tubing unit or a weight-on-bit of the coiled tubing unit based at least in part on the differential pressure measurement.

20 Claims, 4 Drawing Sheets

(56) References Cited

U.S. PATENT DOCUMENTS

| | | | | |
|---|---|---|---|---|
| 6,276,454 | B1 | 8/2001 | Fontana et al. | |
| 8,302,677 | B2 * | 11/2012 | Havinga | F16D 31/02 166/77.2 |
| 8,763,683 | B2 | 7/2014 | Havinga | |
| 9,458,682 | B2 | 10/2016 | McCulloch et al. | |
| 10,260,331 | B2 * | 4/2019 | Viens | E21B 19/16 |
| 10,753,163 | B2 * | 8/2020 | Dobkins | E21B 44/02 |
| 2004/0182574 | A1 | 9/2004 | Adnan et al. | |
| 2007/0246261 | A1 | 10/2007 | Lowe et al. | |
| 2011/0144960 | A1 | 6/2011 | Weng et al. | |
| 2015/0107899 | A1 | 4/2015 | Fisher, Jr. et al. | |
| 2016/0160627 | A1 | 6/2016 | Aitken | |
| 2016/0312552 | A1 | 10/2016 | Early et al. | |
| 2016/0314420 | A1 * | 10/2016 | Livescu | G06Q 50/06 |
| 2017/0145760 | A1 * | 5/2017 | Poyet | E21B 23/00 |
| 2018/0030792 | A1 * | 2/2018 | Witte | E21B 19/22 |

OTHER PUBLICATIONS

Written Opinion Issued in International Application No. PCT/US2020/019870 dated Jun. 23, 2020; 5 Pages.

* cited by examiner

CONTROLLING A COILED TUBING UNIT AT A WELL SITE

BACKGROUND

Embodiments described herein relate generally to downhole exploration and production efforts and more particularly to techniques for controlling a coiled tubing unit at a well site.

In the drilling and completion industry, the formation of boreholes for the purpose of production or injection of fluid is common. The boreholes are used for exploration or extraction of natural resources such as hydrocarbons, oil, gas, water, and alternatively for CO2 sequestration. Coiled tubing is sometimes used for interventions, completion, and/or production strings to control and/or provide a conduit for fluid flow to and/or from the surface or to provide operations similar to wirelining. Coiled tubing is thus useful in many well operations including circulation, pumping, drilling, logging, perforating, and production. Coiled tubing is transported to a well site on spools or reels. An injector head system provides for the deployment and retrieval of the spooled coiled tubing strings.

SUMMARY

According to one embodiment of the present disclosure, a computer-implemented method for controlling a coiled tubing unit at a well site having a wellbore that extends downhole from a surface of the well site is provided. The method includes creating, by a processing device, a coiled tubing simulation for performing a coiled tubing operation. The method further includes receiving, by the processing device, wellbore data, wherein the wellbore data comprises downhole data collected using a downhole sensor downhole in the wellbore, and wherein the downhole data comprises a differential pressure measurement. The method further includes generating, by the processing device, an automated coiled tubing control plan for the coiled tubing unit based at least in part on the wellbore data and the coiled tubing simulation. The method further includes controlling, by the processing device, the coiled tubing unit using the automated coiled tubing control plan to regulate at least one of a rate-of-penetration of the coiled tubing unit or a weight-on-bit of the coiled tubing unit based at least in part on the differential pressure measurement.

According to another embodiment of the present disclosure, a system for controlling a coiled tubing unit at a well site having a wellbore that extends downhole from a surface of the well site is provided. The system includes a memory having computer readable instructions, and a processing device for executing the computer readable instructions for performing a method. The method includes creating, by the processing device, a coiled tubing simulation for performing a coiled tubing operation. The method further includes receiving, by the processing device, wellbore data, wherein the wellbore data comprises downhole data collected using a downhole sensor downhole in the wellbore, and wherein the downhole data comprises a differential pressure measurement. The method further includes generating, by the processing device, an automated coiled tubing control plan for the coiled tubing unit based at least in part on the wellbore data and the coiled tubing simulation. The method further includes controlling, by the processing device, the coiled tubing unit using the automated coiled tubing control plan to regulate at least one of a rate-of-penetration of the coiled tubing unit or a weight-on-bit of the coiled tubing unit based at least in part on the differential pressure measurement.

BRIEF DESCRIPTION OF THE DRAWINGS

Referring now to the drawings wherein like elements are numbered alike in the several figures.

DETAILED DESCRIPTION

Figure 1:
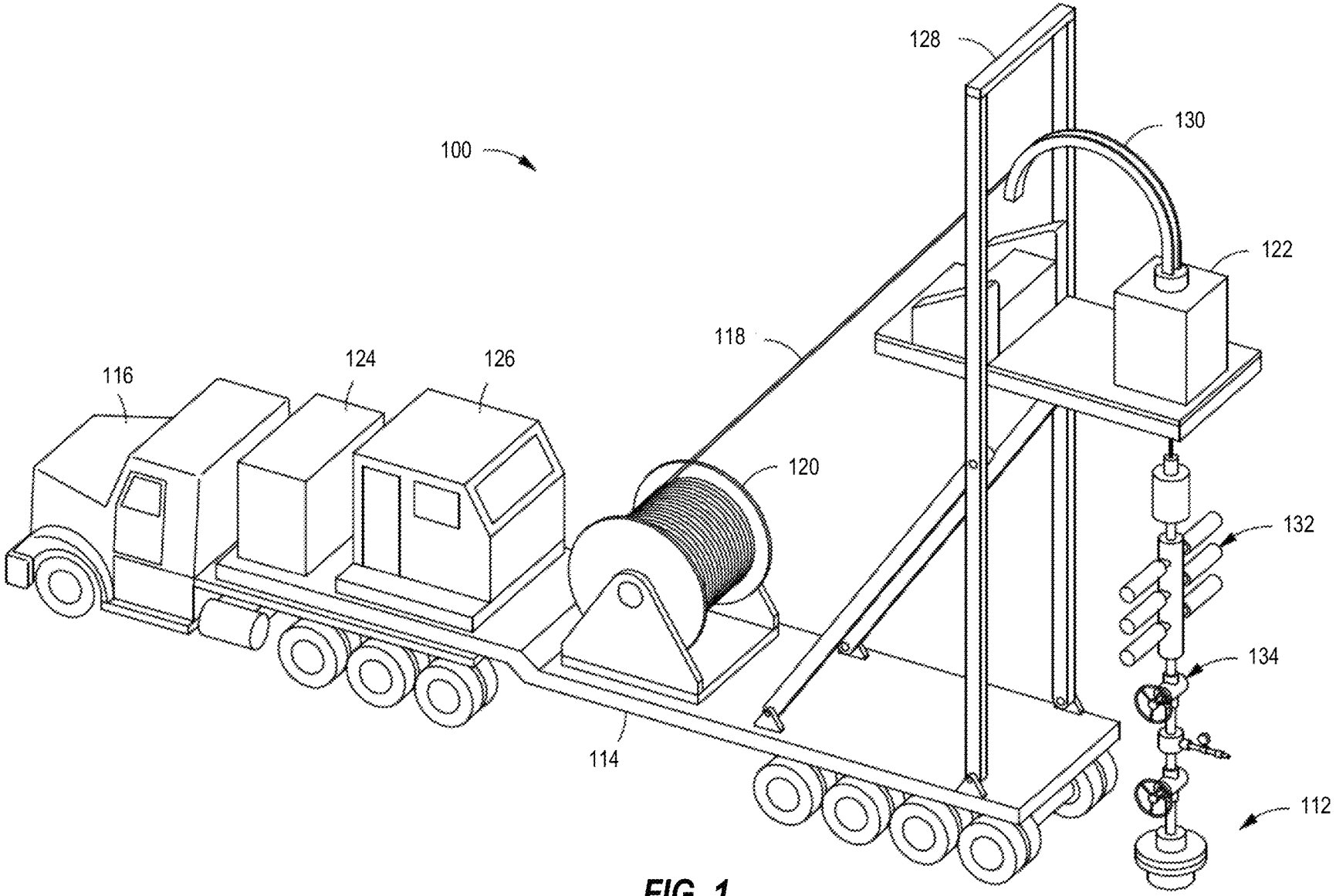
FIG. 1 depicts a side perspective view of a coiled tubing unit in operation at a well site according to one or more embodiments described herein.

The present techniques relate to controlling a coiled tubing unit at a well site. Existing coiled tubing units rely on set pressure limits (e.g., a minimum pressure and maximum pressure) to protect coiled tubing. However, existing coiled tubing units are otherwise manual (i.e., performed by an operator), and the limits merely impose limits on the operator's actions. For example, minimum and maximum pressure limits represent pressure limits that can be applied to an injector of the coiled tubing unit and in turn how much weight can be controlled with the coiled tubing. Such limits only restrict an operator's manual inputs to protect the coil tubing from breaking.

The present techniques automate functions of a coiled tubing unit. Automated coiled tubing units can control the following operations: control weight-on-bit (WOB), control rate-of-penetration (ROP), and control WOB and/or ROP based on differential pressure. The present techniques provide fine control to control WOB and ROP while maintaining a targeted differential pressure range. Differential pressure is a difference between two pressure measurements. As described herein in the context of coiled tubing operations, differential pressure refers to a difference between pressure upstream of the BHA and the wellbore pressure.

The present techniques enable dynamically adjusting the ROP based on both WOB and differential pressure. For example, if the WOB and/or the differential pressure are within predefined limits, the ROP can be increased to a maximum limit. To do this, the present techniques provide for creating a coiled tubing simulation for performing a coiled tubing operation, generating an automated coiled tubing control plan based on wellbore data (received from surface sensor(s) and/or downhole sensor(s)) and the coiled tubing simulation, and then controlling the coiled tubing unit using the automated coiled tubing control plan to regulate at least one of ROP of the coiled tubing unit or WOB of the coiled tubing unit based at least in part on the differential pressure measurement. The automated coiled tubing control plan can then be adjusted based on a sensed condition during the controlling of the coiled tubing unit. For example, WOB and/or ROP can be adjusted dynamically based on changes in differential pressure.

As described herein, the concept of dynamically adjusting the WOB and/or ROP refers to adjusting the coiled tubing operation (such as by a processing system (i.e., a coiled tubing unit control system)) to account for changing conditions in the wellbore during the coiled tubing operation. For example, if monitored parameters for WOB, ROP, and/or differential pressure change due to changes in wellbore conditions (i.e., a "sensed condition"), the present techniques provide for controlling the coiled tubing unit to regulate ROP and/or WOB based on differential pressure to account for the changes in the wellbore conditions. In this way, drilling or milling operations using a coiled tubing unit can be optimized and improved. According to one or more embodiments described herein, if WOB increases, such as due to wellbore conditions changing, the ROP can be reduced. As another example, if the WOB decreases, that the ROP can be increased as long as the differential pressure is within a defined range. An operator of a coiled tubing unit can further limit the defined range of the differential pressure, for example, to meet requirements as determined by the operation, a customer, a skill level of the operator, etc.

FIG. 1 depicts a side perspective view of a coiled tubing unit 100 in operation at a well site 112 according to aspects of the present disclosure. The coiled tubing unit 100 can be trailer mounted upon a trailer bed 114 (or flat car) for transportability, and movable by truck 116, or alternatively by train or another suitable vehicle. In another embodiment, the coiled tubing unit 100 can be provided on an offshore ship or floating rig site, or directly at the surface of the well site 112.

Coiled tubing 118 is spooled on tubing reel 120, disposed on the trailer bed 114, and deliverable to the well site 112 by the truck 116. A coiled tubing injector head 122 is arranged to inject the coiled tubing 118 into a wellbore (not shown) that extends downhole from the surface of the well site 112. The coiled tubing injector head 122 is also able to remove the coiled tubing 118 from the wellbore.

The coiled tubing unit 100 includes a power pack 124, a control cabin 126, the tubing reel 120, support frame 128 (or crane), gooseneck tubing guide 130, and the coiled tubing injector head 122. The power pack 124 can be a skid that includes the hydraulic pump(s) and return tank(s) (i.e., a hydraulic circuit) for the coiled tubing injector head 122 as well as an injector directional control system. The control cabin 126 includes at least portions of an intelligent injector control system (as will be further described herein), computer, console, seating, monitors, and/or controls.

The support frame 128 supports the coiled tubing injector head 122 at the well site 112, while the gooseneck tubing guide 130 provides the proper radius of curvature and support for the coiled tubing 118 to be spooled off the tubing reel 120 and through the coiled tubing injector head 122. The coiled tubing 118 from the tubing reel 120 is delivered through a blowout preventer stack 132 and wellhead equipment 134 to be pushed into (or pulled out of) the wellbore (or casing or other tubular structure within the wellbore) by the coiled tubing injector head 122. In some examples, the coiled tubing unit 100 enables the extraction of natural resources.

Figure 2:
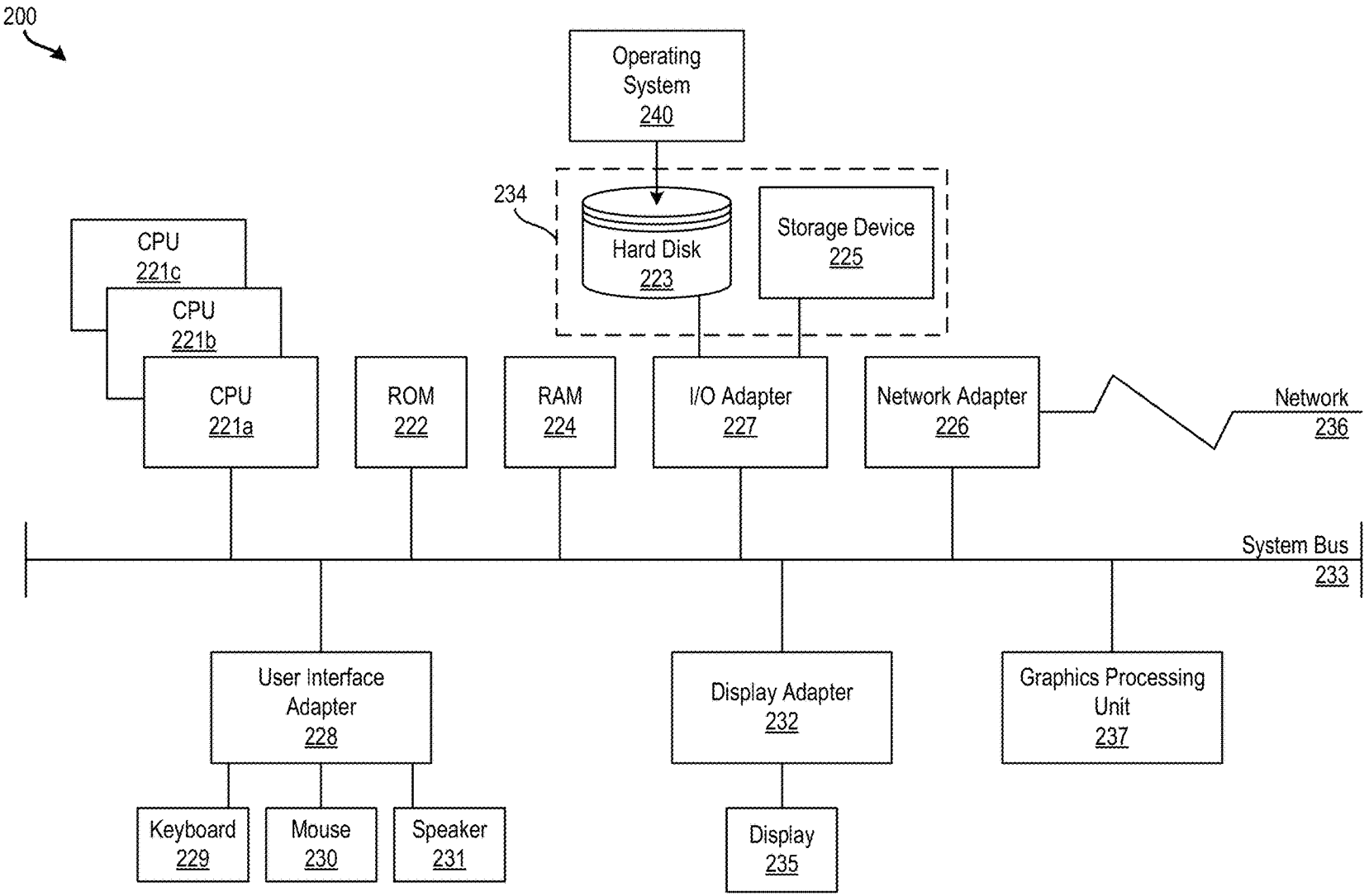
FIG. 2 depicts a block diagram of the processing system, which can be used for implementing the present techniques according to one or more embodiments described herein.

It is understood that embodiments of the present disclosure are capable of being implemented in conjunction with any suitable type of computing environment now known or later developed. For example, FIG. 2 depicts a block diagram of a processing system 200, which can be used for implementing the techniques described herein. According to one or more embodiments described herein, the processing system 200 is disposed in the control cabin 126. In examples, processing system 200 has one or more central processing units (processors) 221*a*, 221*b*, 221*c*, etc. (collectively or generically referred to as processor(s) 221 and/or as processing device(s)). In aspects of the present disclosure, each processor 221 can include a reduced instruction set computer (RISC) microprocessor. Processors 221 are coupled to system memory (e.g., random access memory (RAM) 224) and various other components via a system bus 233. Read only memory (ROM) 222 is coupled to system bus 233 and can include a basic input/output system (BIOS), which controls certain basic functions of processing system 200.

Further illustrated are an input/output (I/O) adapter 227 and a network adapter 226 coupled to system bus 233. I/O adapter 227 can be a small computer system interface (SCSI) adapter that communicates with a hard disk 223 and/or a storage device 225, such a solid state drive, tape drive, or any other similar component. I/O adapter 227, hard disk 223, and storage device 225 are collectively referred to herein as mass storage 234. Operating system 240 for execution on processing system 200 can be stored in mass storage 234. The network adapter 226 interconnects system bus 233 with an outside network 236 enabling processing system 200 to communicate with other such systems.

A display (e.g., a display monitor) 235 is connected to system bus 233 by a display adapter 232, which can include a graphics adapter to improve the performance of graphics intensive applications and a video controller. In one aspect of the present disclosure, adapters 226, 227, and/or 232 can be connected to one or more I/O buses that are connected to system bus 233 via an intermediate bus bridge (not shown). Suitable I/O buses for connecting peripheral devices such as hard disk controllers, network adapters, and graphics adapters typically include common protocols, such as the Peripheral Component Interconnect (PCI). Additional input/output devices are shown as connected to system bus 233 via user interface adapter 228 and display adapter 232. A keyboard 229, mouse 230, and speaker 231 (among others) can be interconnected to system bus 233 via user interface adapter 228, which can include, for example, a Super I/O chip integrating multiple device adapters into a single integrated circuit.

In some aspects of the present disclosure, processing system 200 includes a graphics processing unit 237. Graphics processing unit 237 is a specialized electronic circuit designed to manipulate and alter memory to accelerate the creation of images in a frame buffer intended for output to a display. In general, graphics processing unit 237 is very efficient at manipulating computer graphics and image processing and has a highly parallel structure that makes it more effective than general-purpose CPUs for algorithms where processing of large blocks of data is done in parallel.

Thus, as configured herein, processing system 200 includes processing capability in the form of processors 221, storage capability including system memory (e.g., RAM 224), and mass storage 234, input means such as keyboard 229 and mouse 230, and output capability including speaker 231 and display 235. In some aspects of the present disclosure, a portion of system memory (e.g., RAM 224) and mass storage 234 collectively store an operating system 240 to coordinate the functions of the various components shown in processing system 200.

Figure 3:
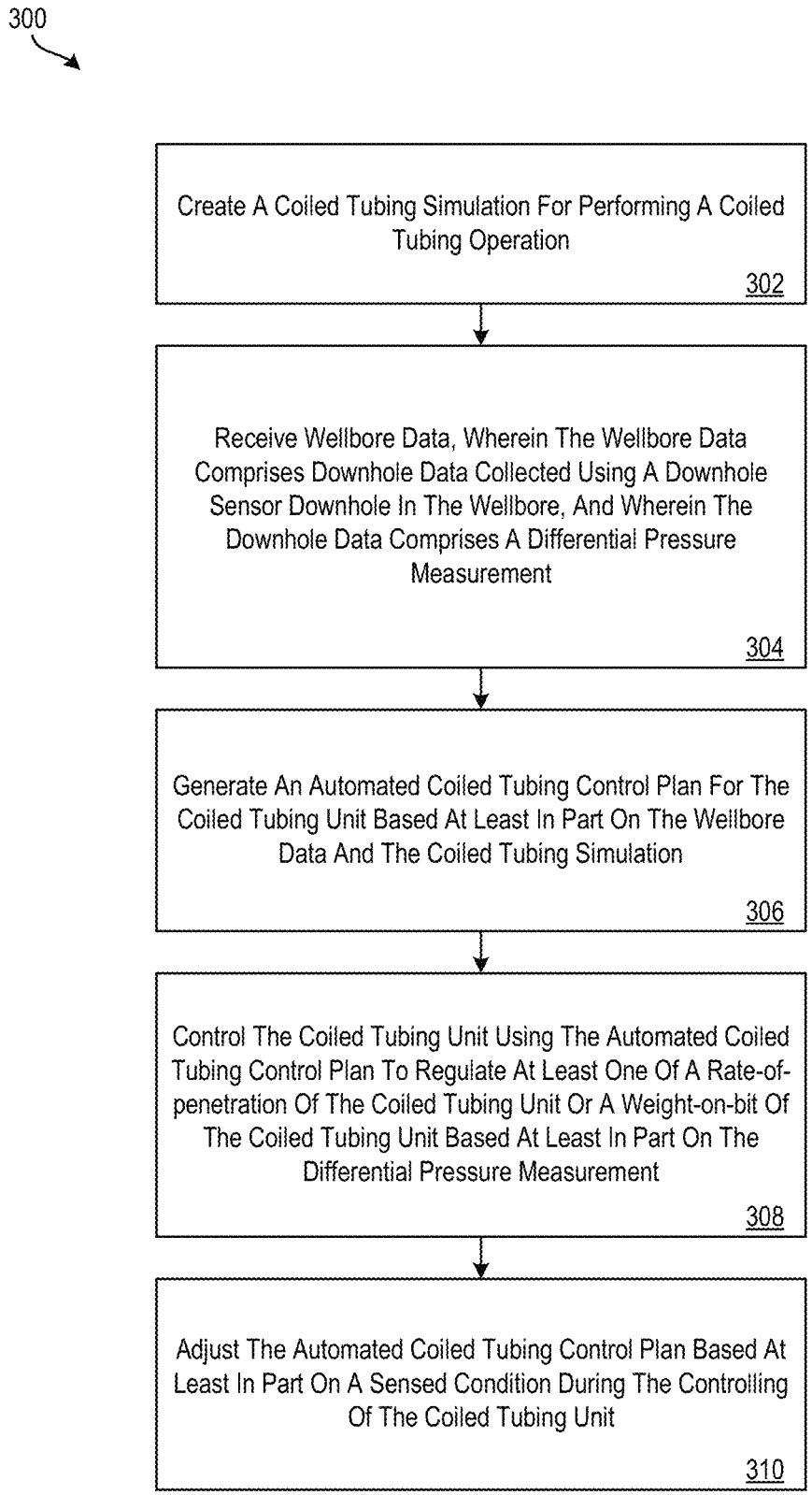
FIG. 3 depicts a flow diagram of a method for controlling the coiled tubing unit at a well site having a wellbore that extends downhole from a surface of the well site according to one or more embodiments described herein.

FIG. 3 depicts a flow diagram of a method 300 for controlling the coiled tubing unit 100 at a well site 112 having a wellbore that extends downhole from a surface of the well site 112, according to one or more embodiments described herein. The method 300 can be implemented by any suitable control or processing system, such as the processing system 200 of FIG. 2 or the system 400 of FIG.

4 (described below). Although the coiled tubing unit can be the coiled tubing unit 100 of FIG. 1, the coiled tubing unit can also be another suitable coiled tubing unit.

At block 302, a processing system (e.g., the processing system 200) creates a coiled tubing simulation for performing a coiled tubing operation. The coiled tubing simulation generates coiled tubing data, which can be used to define the safety and/or operational set points, such as coil rates, target depths, etc.

At block 304, the processing system receives wellbore data that includes downhole data collected using a downhole sensor downhole in the wellbore. According to one or more embodiments described herein, the downhole data comprises a differential pressure measurement. The differential pressure measurement is a difference between two pressure measurements such as a difference between the pressure above the BHA and the wellbore pressure. The differential pressure can be measured by one or more pressure sensors located downhole in the wellbore. According to one or more embodiments described herein, the wellbore data also includes surface data collected using a surface sensor at the surface of the wellbore.

At block 306, the processing system generates an automated coiled tubing control plan for the coiled tubing unit 100 based at least in part on the wellbore data and the coiled tubing simulation. According to one or more embodiments described herein, the automated coiled tubing control plan sets a coil rate, a direction, and a force for controlling the coiled tubing unit. In some examples, the coil rate, the direction, and the force are set differently for different depths. Other parameters can also be set as part of the automated coiled tubing control plan.

At block 308, the processing system controls the coiled tubing unit 100 using the automated coiled tubing control plan to regulate at least one of a rate-of-penetration of the coiled tubing unit 100 or a weight-on-bit of the coiled tubing unit 100 based at least in part on the differential pressure measurement. According to one or more embodiments described herein, controlling the coiled tubing unit includes controlling a hydraulic system that controls the coiled tubing injector head 122 of the coiled tubing unit. By regulating ROP and/or WOB based on differential pressure, the coiled tubing unit can be improved, for example, by reducing kick.

According to one or more embodiments described herein, regulating the rate-of-penetration of the coiled tubing unit based at least in part on the differential pressure measurement prevents the coiled tubing unit 100 from exceeding a maximum rate-of-penetration limit. By preventing the coiled tubing unit 100 from exceeding the maximum ROP limit, the coiled tubing 100 is improved. For example, this improves coiled tubing technology by, for example, preventing damage to the coiled tubing unit 100 and its components, improving the life expectancy of the coiled tubing unit 100 and its components, etc.

According to one or more embodiments described herein, wherein regulating the weight-on-bit of the coiled tubing unit based at least in part on the differential pressure measurement prevents the coiled tubing unit from exceeding a maximum weight-on-bit limit. This similarly improves the coiled tubing unit 100 by, for example, preventing damage to the coiled tubing unit 100 and its components, improving the life expectancy of the coiled tubing unit 100 and its components, etc.

At block 310, the processing system adjusts the automated coiled tubing control plan based at least in part on a sensed condition during the controlling of the coiled tubing unit 100. For example, a sensed condition can include a change in formation, which can cause a change in pressure. In such cases, the automated coiled tubing control plan can be adjusted to account for the sensed condition (i.e., the change in formation).

Figure 4:
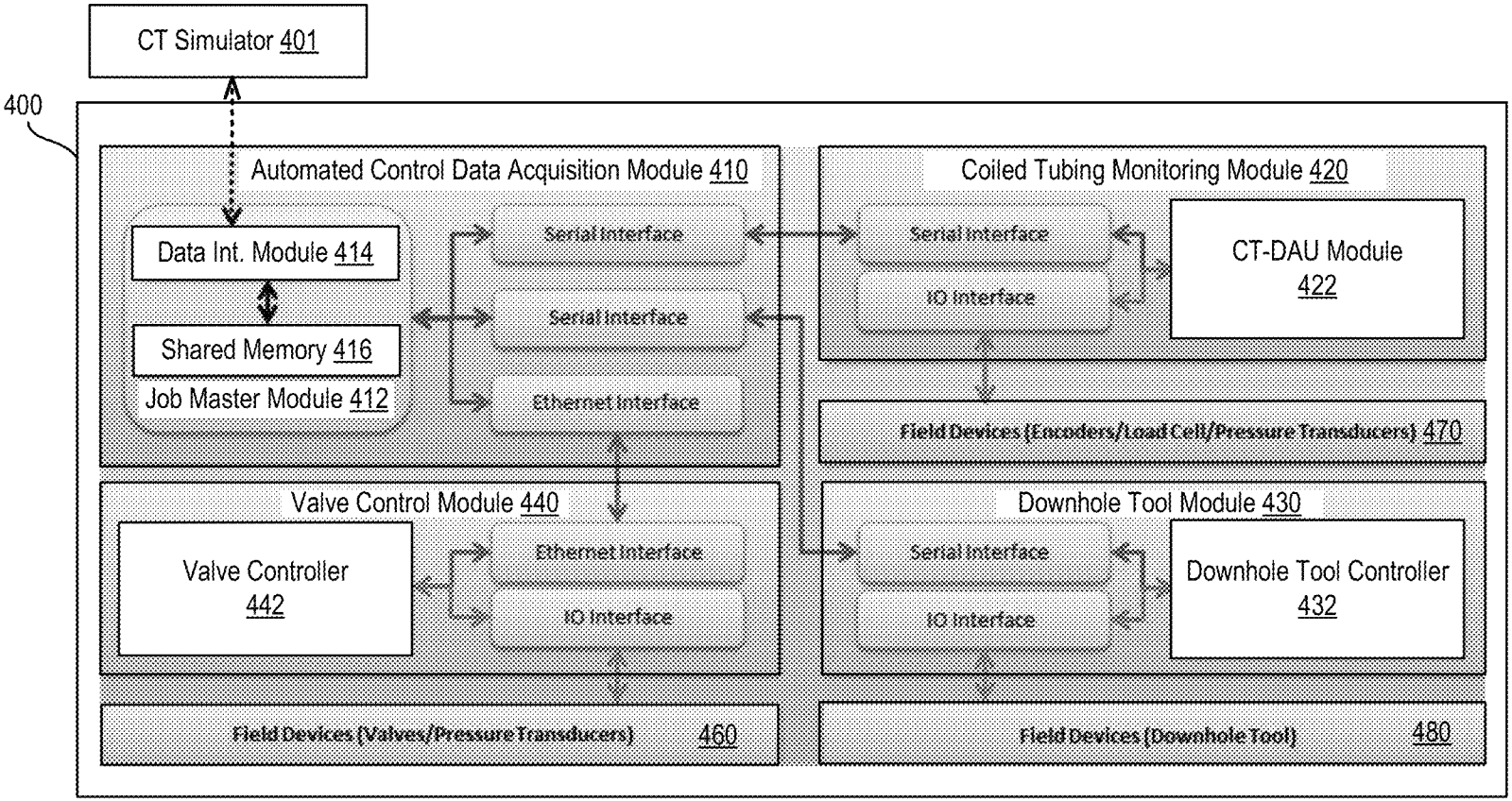
FIG. 4 depicts a block diagram of an autodrill control system for controlling a coiled tubing unit at a well site according to one or more embodiments described herein.

Additional processes also can be included, and it should be understood that the processes depicted in FIG. 4 represent illustrations and that other processes can be added or existing processes can be removed, modified, or rearranged without departing from the scope and spirit of the present disclosure.

FIG. 4 depicts a block diagram of an autodrill control system 400 for controlling a coiled tubing unit at a well site according to aspects of the present disclosure. The system 400, which may be referred to as an autodrill control system, includes different modules responsible for control and data acquisition, and the modules are communicatively connected to one another as shown, for example. The coiled tubing unit can be the coiled tubing unit 100 of FIG. 1 or another suitable coiled tubing unit.

An autodrill control system, such as the system 400 of FIG. 4, performs automatic drilling control of a coiled tubing unit, such as the control tubing unit 100. The example system 400 includes several modules: an automated control data acquisition module 410, a coiled tubing monitoring module 420, a downhole tool module 430, and a valve control module 440.

The automated control data acquisition module 410 includes a job master module 412 having a shared memory 416 and a data integration module 414. The data integration module 414 receives the coiled tubing simulation data from a coiled tubing (CT) simulator 401. Based on the CT simulation data, as well as data received from other of the modules of FIG. 4 (each described herein), the data integration module 414 defines safety/operational set points (e.g., coil rates, target depths, etc.) and provides warnings and alerts to well site operators/technicians during coiled tubing units.

The job master module 412 functions as a communication controller (e.g., a Modbus TCP/IP master) and performs real-time data acquisition functions to collect job data from the various modules within the system 400. The job master module 412 can utilize Ethernet sub-systems, for example, and can also form a communicative interface to connect to the coiled tubing monitoring module 420 via serial interfaces within each module. The job master module 412 uses a shared memory interface for communication with the data integration module 414. This interface enables the data integration module to access the various data/parameters that the job master module 412 records. In the example of FIG. 4, the job master module 412 can be connected to the coiled tubing monitoring module 420, the downhole tool module 430, and/or the valve control module 440.

The valve control module 440 includes a valve controller 442 that performs low-level control of the coiled tubing injector head 122 and traction pressures to maintain equipment weight limits provided by the data integration module 414. This enables, for example, speed and direction control for the coiled tubing unit 100. The drilling depths and the coil rate set point provided by the data integration module 414, the equipment specification, and/or the hydraulic circuit design can be used to develop functions needed for low-level control. According to one or more embodiments described herein, the valve control module 440 sends signals to and/or receives data from field devices 460, such as valves, pressure transducers, etc.

The coiled tubing monitoring module 420 monitors the coiled tubing unit (e.g., the coiled tubing unit 100) and collects data relating thereto in real time. The coiled tubing monitoring module 420 includes a coiled tubing data acquisition unit (CT-DAU) module 422 and can also include an interface(s) (e.g., a serial interface, an Ethernet interface, an I/O interface etc.) to communicatively connect the coiled tubing monitoring module 420 to other modules, such as the automated control data acquisition module 410 and/or field devices 470 (e.g., encoders, load cells, pressure transducers, etc.), among others. The field devices 470 are devices associated with the coiled tubing unit (e.g., the coiled tubing unit) and provide data to the coiled tubing monitoring module 420 via the I/O interface, for example.

The CT-DAU module 422 performs real-time updates for field device measurements including measures from a dual encoder (used to calculate a depth that the coiled tubing has traveled down the well) and a load cell (used to calculate a weight applied to the coiled tubing). Feedback requirements for the CT-DAU module 422 can vary based on the coiled tubing job design and could utilize more feedback for data recording and analysis purposes.

The valve control module 440 performs low-level control of injector and traction pressures to maintain equipment weight limitations provided by the data integration module 414. The present techniques enable speed, direction, and tension control for the coiled tubing unit 100. The depth and coil rate set points provided by the data integration module 414, the equipment specification, and the hydraulic circuit design are used to develop the functionality used for the low-level control. The valve control module 440 includes a valve controller 442 and can also include an interface(s) (e.g., a serial interface, an Ethernet interface, an I/O interface etc.) to communicatively connect the valve control module 440 to other modules, such as the automated control data acquisition module 410 and/or field devices (e.g., encoders, load cells, pressure transducers, etc.), among others. The valve controller 442 also provides speed and direction control of the coiled tubing unit. The drilling depths and coil rate set point provided by the data integration module 414, the equipment specification(s), and/or the hydraulic circuit design can be used to develop functionality needed for low-level control.

The downhole tool module 430 includes a downhole tool controller 432 and can also include an interface(s) (e.g., a serial interface, an Ethernet interface, an I/O interface etc.) to communicatively connect the downhole tool module 430 to other modules, such as the automated control data acquisition module 410, the valve control module 440, etc. The downhole tool controller 432 performs real-time updates for field device measurements including measurements of the depth in which the coil has traveled down the well and the weight applied to the equipment. According to one or more embodiments described herein, the downhole tool module 430 sends signals to and/or receives data from field devices 480, such as a downhole tool.

The system 400 can be configured to generate an automated coiled tubing control plan and to control the coiled tubing unit 100 using the automated coiled tubing control plan, as described with respect to FIG. 3. According to aspects of the present disclosure, different automated coiled tubing control plans (i.e., integrated control procedures) are possible. For example, automated coiled tubing control plans can define various ready procedures and autodrill control mode procedures. These procedures are described below, although it should be appreciated that the procedures are merely examples and that other procedures, modifications thereto, and/or combinations thereof are also possible.

Examples of ready procedures can include an automated control mode ready procedure, a manual control mode with intelligent injector control system (IICS) active ready procedure, and a manual control mode ready procedure.

For the automated control mode ready procedure, the data integration module 414 sends a control mode signal to the valve controller 442 to set to "autodrill." The valve controller 442 reads the autodrill control mode signal and checks that there are no errors in field device measures, interfaces, or controls. The valve controller 442 then configures itself for autodrill if there are no errors. The valve controller 442 maintains a safe pressure reference for the hydraulic system(s) of the coiled tubing unit 100 using real-time updates from field device measures and data provided by the data job master module 412. The data integration module 414 performs real-time updates of data using updated data samples from the shared memory 416. The data samples include field device measurements and automated controls and feedback. The job master module 412 performs real-time updates of the communication controller (e.g., a Modbus TCP/IP master) of the automated control data acquisition module 410, serial interface, and/or shared memory 416 registers. The CT-DAU module 422 performs real-time updates of field device measurements and serial output registers. Finally, the downhole tool controller 432 performs real-time updates of field device measurements and serial output registers.

For the manual control mode with IICS active ready procedure, the data integration module 414 sends a control mode signal to the valve controller 442 to set to "IICS." The valve controller 442 reads the IICS control mode signal from the data integration module 414, checks that there are no errors in field device measurements, interfaces, or controls, and configures itself for IICS. The valve controller 442 maintains a safe pressure reference for the hydraulic system(s) of the coiled tubing unit 100 using real-time updates from field device measures and data provided by the data job master module 412. The data integration module 414 performs real-time updates of data using updated data samples from the shared memory 416. The data samples include field device measurements and automated controls and feedback. The job master module 412 performs real-time updates of the communication controller (e.g., a Modbus TCP/IP master) of the automated control data acquisition module 410, serial interface, and/or shared memory 416 registers. The CT-DAU module 422 performs real-time updates of field device measurements and serial output registers. Finally, the downhole tool controller 432 performs real-time updates of field device measurements and serial output registers.

For the manual control mode ready procedure, an injector control switch for the coiled tubing unit 100 is in an OFF position, and the valve controller 442 disables interlocks. The valve controller 442 performs real-time updates of field device measurements and monitors the current mode of operation. The data integration module 414 performs real-time updates of data using updated data samples from the shared memory 416. The data samples include field device measurements and automated controls and feedback. The job master module 412 performs real-time updates of the communication controller (e.g., a Modbus TCP/IP master) of the automated control data acquisition module 410, serial interface, and/or shared memory 416 registers. The CT-DAU module 422 performs real-time updates of field device measurements and serial output registers. Finally, the downhole tool controller 432 performs real-time updates of field device measurements and serial output registers.

Examples of autodrill control procedures can include an activating procedure, a pausing procedure, and a fault procedure.

For the activating procedure, an operator checks that an injector pilot adjustment and directional controls are set to the correct positions to begin autodrill control. The correct positions are defined in operations procedures. The operator changes an injector control switch of the coiled tubing unit 100 to the ON position. The valve controller 442 sends the ON signal to the job master module 412. The data integration module 414 reads the ON signal from the job master module 412. The valve controller 442 rams to the coil rate provided by the data integration module 414 and monitors the maximum pull limit, maximum snub limit, and differential pressure provided by the data integration module 414.

For the pausing procedure, the control mode signal stays the same as the activating sequence and the data integration module 414 sets the coil rate to zero. The valve controller 442 sets the coil rate to zero.

For the fault procedure, the valve controller 442 detects a fault condition and sends a low-level common fault signal to the job master module 412. The data integration module 414 reads the fault signal from the job master module 412 and displays "autodrill not active" or another suitable message to the operator. The valve controller 442 sets the coil rate to zero and sends an "inactive" signal to the job master module 412. The valve controller 442 inactive until the fault condition is corrected. The data integration module 414 reads this inactive signal as an OFF signal.

It should be appreciated that each of these procedures can be partially and/or wholly implemented as the automated coiled tubing control plan. It should further be appreciated that the automated coiled tubing control plan can include any suitable number and combination of these procedures.

Set forth below are some embodiments of the foregoing disclosure:

Embodiment 1: A computer-implemented method for controlling a coiled tubing unit at a well site having a wellbore that extends downhole from a surface of the well site, the method comprising: creating, by a processing device, a coiled tubing simulation for performing a coiled tubing operation; receiving, by the processing device, wellbore data, wherein the wellbore data comprises downhole data collected using a downhole sensor downhole in the wellbore, and wherein the downhole data comprises a differential pressure measurement; generating, by the processing device, an automated coiled tubing control plan for the coiled tubing unit based at least in part on the wellbore data and the coiled tubing simulation; and controlling, by the processing device, the coiled tubing unit using the automated coiled tubing control plan to regulate at least one of a rate-of-penetration of the coiled tubing unit or a weight-on-bit of the coiled tubing unit based at least in part on the differential pressure measurement.

Embodiment 2: The system of any prior embodiment further comprising controlling the coiled tubing unit comprises controlling a hydraulic system that controls a coiled tubing injector head of the coiled tubing unit.

Embodiment 3: The system of any prior embodiment, wherein the automated coiled tubing control plan sets a coil rate, a direction, and a force for controlling the coiled tubing unit.

Embodiment 4: The system of any prior embodiment, wherein the coil rate, the direction, and the force are set differently for different depths.

Embodiment 5: The system of any prior embodiment, wherein regulating the rate-of-penetration of the coiled tubing unit based at least in part on the differential pressure measurement prevents the coiled tubing unit from exceeding a maximum rate-of-penetration limit.

Embodiment 6: The system of any prior embodiment, wherein regulating the rate-of-penetration of the coiled tubing unit based at least in part on the differential pressure measurement maintains the rate-of-penetration above a minimum rate-of-penetration limit.

Embodiment 7: The system of any prior embodiment, wherein regulating the weight-on-bit of the coiled tubing unit based at least in part on the differential pressure measurement prevents the coiled tubing unit from exceeding a maximum weight-on-bit limit.

Embodiment 8: The system of any prior embodiment, wherein regulating the weight-on-bit of the coiled tubing unit based at least in part on the differential pressure measurement maintains the weight-on-bit above a minimum weight-on-bit limit.

Embodiment 9: The system of any prior embodiment, wherein the wellbore data further comprises surface data collected using a surface sensor at the surface of the wellbore.

Embodiment 10: The system of any prior embodiment, further comprising adjusting, by the processing device, the automated coiled tubing control plan based at least in part on a sensed condition during the controlling of the coiled tubing unit.

Embodiment 11: A system for controlling a coiled tubing unit at a well site having a wellbore that extends downhole from a surface of the well site, the system comprising: a memory comprising computer readable instructions; and a processing device for executing the computer readable instructions for performing a method, the method comprising: creating, by the processing device, a coiled tubing simulation for performing a coiled tubing operation; receiving, by the processing device, wellbore data, wherein the wellbore data comprises downhole data collected using a downhole sensor downhole in the wellbore, and wherein the downhole data comprises a differential pressure measurement; generating, by the processing device, an automated coiled tubing control plan for the coiled tubing unit based at least in part on the wellbore data and the coiled tubing simulation; and controlling, by the processing device, the coiled tubing unit using the automated coiled tubing control plan to regulate at least one of a rate-of-penetration of the coiled tubing unit or a weight-on-bit of the coiled tubing unit based at least in part on the differential pressure measurement.

Embodiment 12: The system of any prior embodiment further comprising controlling the coiled tubing unit comprises controlling a hydraulic system that controls a coiled tubing injector head of the coiled tubing unit.

Embodiment 13: The system comprising the automated coiled tubing control plan sets a coil rate, a direction, and a force for controlling the coiled tubing unit.

Embodiment 14: The system comprising the coil rate, the direction, and the force are set differently for different depths.

Embodiment 15: The system of any prior embodiment, wherein regulating the rate-of-penetration of the coiled tubing unit based at least in part on the differential pressure measurement prevents the coiled tubing unit from exceeding a maximum rate-of-penetration limit.

Embodiment 16: The system of any prior embodiment, wherein regulating the rate-of-penetration of the coiled tubing unit based at least in part on the differential pressure measurement maintains the rate-of-penetration above a minimum rate-of-penetration limit.

Embodiment 17: The system of any prior embodiment, wherein regulating the weight-on-bit of the coiled tubing unit based at least in part on the differential pressure measurement prevents the coiled tubing unit from exceeding a maximum weight-on-bit limit.

Embodiment 18: The system of any prior embodiment, wherein regulating the weight-on-bit of the coiled tubing unit based at least in part on the differential pressure measurement maintains the weight-on-bit above a minimum weight-on-bit limit.

Embodiment 19: The system of any prior embodiment, wherein the wellbore data further comprises surface data collected using a surface sensor at the surface of the wellbore.

Embodiment 20: The system of any prior embodiment further comprising adjusting, by the processing device, the automated coiled tubing control plan based at least in part on a sensed condition during the controlling of the coiled tubing unit.

The use of the terms "a" and "an" and "the" and similar referents in the context of describing the present disclosure (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure can be used in a variety of well operations. These operations can involve using one or more treatment agents to treat a formation, the fluids resident in a formation, a wellbore, and/or equipment in the wellbore, such as production tubing. The treatment agents can be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the present disclosure has been described with reference to an exemplary embodiment or embodiments, it will be understood by those skilled in the art that various changes can be made and equivalents can be substituted for elements thereof without departing from the scope of the present disclosure. In addition, many modifications can be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims. Also, in the drawings and the description, there have been disclosed exemplary embodiments of the present disclosure and, although specific terms can have been employed, they are unless otherwise stated used in a generic and descriptive sense only and not for purposes of limitation, the scope of the present disclosure therefore not being so limited.

What is claimed is:

1. A computer-implemented method for controlling a coiled tubing unit at a well site having a wellbore that extends downhole from a surface of the well site, the method comprising:

creating, by a processing device, a coiled tubing simulation for performing a coiled tubing operation;

receiving, by the processing device, wellbore data, wherein the wellbore data comprises downhole data collected using a downhole sensor downhole in the wellbore, and wherein the downhole data comprises a differential pressure measurement;

generating, by the processing device, an automated coiled tubing control plan for the coiled tubing unit based at least in part on the wellbore data and the coiled tubing simulation; and controlling, by the processing device, coiled tubing of the coiled tubing unit using the automated coiled tubing control plan to regulate at least one of a rate-of-penetration of the coiled tubing or a weight-on-bit of the coiled tubing based at least in part on the differential pressure measurement.

2. The computer-implemented method of claim 1, wherein controlling the coiled tubing of the coiled tubing unit comprises controlling a hydraulic system that controls a coiled tubing injector head of the coiled tubing unit.

3. The computer-implemented method of claim 1, wherein the automated coiled tubing control plan sets a coil rate, a direction, and a force for controlling the coiled tubing unit.

4. The computer-implemented method of claim 3, wherein the coil rate, the direction, and the force are set differently for different depths.

5. The computer-implemented method of claim 1, wherein regulating the rate-of-penetration of the coiled tubing based at least in part on the differential pressure measurement prevents the coiled tubing from exceeding a maximum rate-of-penetration limit.

6. The computer-implemented method of claim 1, wherein regulating the rate-of-penetration of the coiled tubing based at least in part on the differential pressure measurement maintains the rate-of-penetration above a minimum rate-of-penetration limit.

7. The computer-implemented method of claim 1, wherein regulating the weight-on-bit of the coiled tubing based at least in part on the differential pressure measurement prevents the coiled tubing from exceeding a maximum weight-on-bit limit.

8. The computer-implemented method of claim 1, wherein regulating the weight-on-bit of the coiled tubing based at least in part on the differential pressure measurement maintains the weight-on-bit above a minimum weight-on-bit limit.

9. The computer-implemented method of claim 1, wherein the wellbore data further comprises surface data collected using a surface sensor at the surface of the well site.

10. The computer-implemented method of claim 1 further comprising adjusting, by the processing device, the automated coiled tubing control plan based at least in part on a sensed condition during the controlling the coiled tubing of the coiled tubing unit.

11. A system for controlling a coiled tubing unit at a well site having a wellbore that extends downhole from a surface of the well site, the system comprising:

a memory comprising computer readable instructions; and a processing device for executing the computer readable instructions for performing a method, the method comprising:

creating, by the processing device, a coiled tubing simulation for performing a coiled tubing operation;

receiving, by the processing device, wellbore data, wherein the wellbore data comprises downhole data collected using a downhole sensor downhole in the wellbore, and wherein the downhole data comprises a differential pressure measurement;

generating, by the processing device, an automated coiled tubing control plan for the coiled tubing unit based at least in part on the wellbore data and the coiled tubing simulation; and controlling, by the processing device, coiled tubing of the coiled tubing unit using the automated coiled tubing control plan to regulate at least one of a rate-of-penetration of the coiled tubing or a weight-on-bit of the coiled tubing based at least in part on the differential pressure measurement.

12. The system of claim 11, wherein controlling the coiled tubing of the coiled tubing unit comprises controlling a hydraulic system that controls a coiled tubing injector head of the coiled tubing unit.

13. The system of claim 11, wherein the automated coiled tubing control plan sets a coil rate, a direction, and a force for controlling the coiled tubing unit.

14. The system of claim 13, wherein the coil rate, the direction, and the force are set differently for different depths.

15. The system of claim 11, wherein regulating the rate-of-penetration of the coiled tubing based at least in part on the differential pressure measurement prevents the coiled tubing from exceeding a maximum rate-of-penetration limit.

16. The system of claim 11, wherein regulating the rate-of-penetration of the coiled tubing based at least in part on the differential pressure measurement maintains the rate-of-penetration above a minimum rate-of-penetration limit.

17. The system of claim 11, wherein regulating the weight-on-bit of the coiled tubing based at least in part on the differential pressure measurement prevents the coiled tubing from exceeding a maximum weight-on-bit limit.

18. The system of claim 11, wherein regulating the weight-on-bit of the coiled tubing based at least in part on the differential pressure measurement maintains the weight-on-bit above a minimum weight-on-bit limit.

19. The system of claim 11, wherein the wellbore data further comprises surface data collected using a surface sensor at the surface of the well site.

20. The system of claim 11 further comprising adjusting, by the processing device, the automated coiled tubing control plan based at least in part on a sensed condition during the controlling the coiled tubing of the coiled tubing unit.

* * * * *